United States Patent [19]

Kuck

[11] 4,194,203

[45] Mar. 18, 1980

[54] PULSE DOPPLER-RADIO PROXIMITY FUZE

[75] Inventor: John H. Kuck, Silver Spring, Md.

[73] Assignee: The United States of America as represented by the Secretary of the Navy, Washington, D.C.

[21] Appl. No.: 210,851

[22] Filed: Feb. 14, 1951

[51] Int. Cl.[2] ..... F42C 13/04

[52] U.S. Cl. ..... 343/7 PF; 102/214

[58] Field of Search ..... 250/20.26, 13; 343/12, 343/13, 57, 7, 7 PF; 102/70.2 P, 214

[56] References Cited

U.S. PATENT DOCUMENTS

| | | | |
|---|---|---|---|
| 3,125,026 | 3/1964 | Johnson | 102/214 |
| 3,326,130 | 6/1967 | Baker | 343/7 PF X |
| 3,732,564 | 5/1973 | Kuck et al. | 343/7 PF |

*Primary Examiner*—T. H. Tubbesing

*Attorney, Agent, or Firm*—R. S. Sciascia; A. L. Branning

EXEMPLARY CLAIM

1. A radio proximity fuze comprising, an oscillator for generating radio frequency waves, an antenna for propagating said generated waves through space and for receiving waves reflected from a target and propagated through space toward said antenna, a detector for rectifying said generated waves and said received waves, an output connection to said detector for utilizing the detector output to fire said fuze, means for periodically supplying power to said radio frequency oscillator, said power means including a thyratron relaxation oscillator and a connection from said relaxation oscillator to said radio frequency oscillator, and means for rendering said detector insensitive to received waves during periods of non-operation of said oscillator whereby said fuze is afforded protection against jamming by remotely situated radio transmitters.

3 Claims, 4 Drawing Figures

PULSE DOPPLER-RADIO PROXIMITY FUZE

The present invention relates to a pulse doppler-radio proximity fuze, and particularly to a pulse fuze protective system utilizing a pulse forming circuit to obtain impulses at a convenient recurrence rate to cause radiation of signal impulses.

The advent of the radio proximity fuze greatly increased the utility and reliability of explosive projectiles, particularly it made it possible for explosive projectiles to be accurately exploded within the optimum range of any given target. Because of the increased effectiveness of gunnery resulting from the use of the radio proximity fuze many means have been proposed to counteract or decrease its effectiveness. For example, it has been proposed to create simulated reflecting surfaces or pseudo targets to cause explosion of the projectile at a safe distance from the actual target. However, the most effective anti-proximity fuze device has been a repeater jammer device. The repeater jammer system operates by receiving the radiated signal from the proximity fuze, amplifying the signal, and re-radiating it so that the re-radiated signal is received back by the fuze in exactly the same manner as a properly reflected radiation from a normal target. In this manner the jammer is able to produce premature explosions of proximity fuzed missiles without any appreciable danger to it or to the actual targets.

For a repeater jammer to be effective as an anti-proximity device, it is necessary that the re-radiated signal be returned to the proximity fuze while the proximity fuze is in an active receiving condition. If it is possible to render the fuze inactive at the time the jammer signal is received, then no damage could be caused thereby, consequently if the fuze can be operated at an on-and-off condition, or preferably by a periodic or periodic pulses of sufficient duration so that the first radiated waves would only have time to be reflected from the target surface at its maximum permissible distance, then the jammer, which would be at a further distance, would send back its re-radiated signal during an inactive interval of the proximity fuze.

The heretofore known proximity fuzes have emitted continuous radiation which was easily received and reradiated by the repeater jammer.

The present invention provides a pulsing system in which a thyratron relaxation oscillator is utilized to provide impulses which control the operation of an oscillator circuit to which is coupled a gated detector system. In this manner the thyratron oscillator circuit produces relatively short operating pulses of the proximity fuze oscillator system; preferably the pulses are of relative short duration and have a relatively long off period so that the duty cycle of the oscillator is very low, thus making it substantially impossible for a repeater jammer to produce any undesirable jamming effects, and because of the use of the gated detector circuit the detector system is completely unresponsive except during the short interval during which the oscillator is operative.

It is accordingly an object of the invention to produce a radio proximity fuze substantially immune to signals from a repeater jammer.

It is a further object of the invention to provide a radio proximity fuze having spaced apart pulses of radiated signals.

Another object of the invention is to provide a thyratron circuit for controlling the operation of a proximity fuze.

It is still another object of the invention to provide a proximity fuze which is inoperative during a large portion of its duty cycle.

Other objects and many of the attendant advantages of this invention will be readily appreciated as the same becomes understood by reference to the following detailed description when considered in connection with the accompanying drawings wherein.

Figure 1:
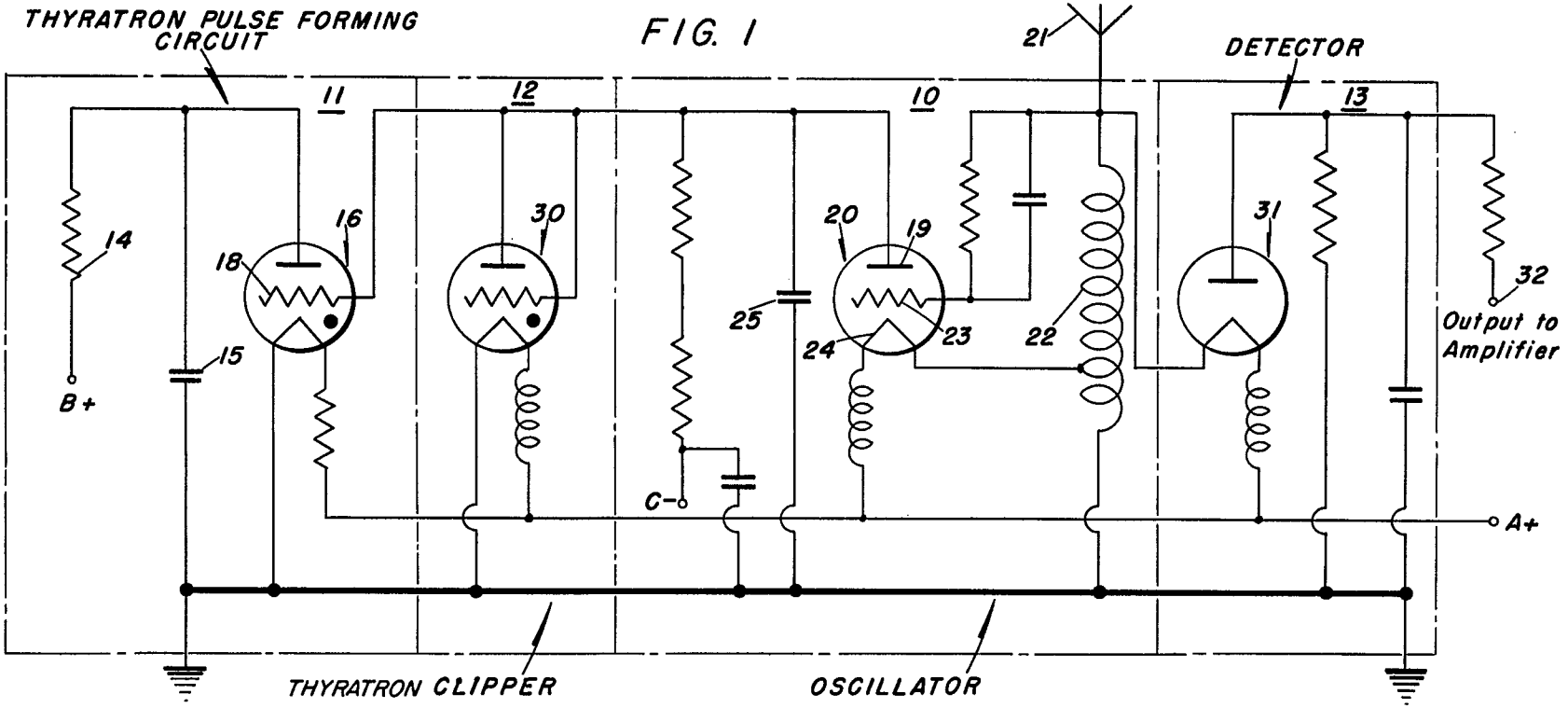
FIG. 1 is a circuit diagram of a proximity fuze oscillator involving the invention.

In an exemplary embodiment of the invention according to FIG. 1, the fuze system consists of an oscillator 10 controlled by a pulse generator or pulse forming circuit 11 and a clipper 12 for determining the the length of the pulse. The reflected signals are received through the oscillator 10 by a gated detector 13.

The pulse forming circuit 11 is in the nature of a relaxation oscillator receiving energy from any source such as a battery through an impedance 14 to charge a capacitor 15 which discharges through a thyratron 16 having a grid 18. The system takes advantage of the fact that at the instant of discharge in a thyratron the grid 18 becomes momentarily positive.

The positive potential of the grid 18 is utilized to produce pulse operation of the oscillator 10 by impressing the potential of said grid on the plate 19 of the triode oscillator tube 20 to serve as the power source for the oscillator 10. The oscillator 10 can of course be any suitable type of oscillator but it is desirable to use simple and dependable circuits requiring a small number of components and is shown as having a tank coil 22 connected between an antenna 21 and ground with suitable coupling to the grid 23 and cathode 24 of the triode or oscillator tube 20. The usual high frequency bypass capacitor 25 is connected across the potential source or from grid 18 to ground.

The clipper 12 is provided to control the length of the pulse and consists of a gas filled triode clipper tube 30, which is connected between the power supply of the oscillator 10 and ground, and a slight time-delay occurs after the initiation of the impulse before the clipper tube 30 shorts out or grounds the power supply to the oscillator 10, so that the oscillator 10 is active only during the short interval during which power is supplied to the plate 19 of tube 20.

The detector 13 includes a diode detector tube 31 which is connected through the oscillator 10 so that it can receive signals only during the interval when the oscillator 10 is operating. The output of the detector 13 is connected to terminal 32 of a suitable amplifying device (not shown) and is used to trigger or detonate the squib or primer of the explosive carried by the projectile.

Figure 2:
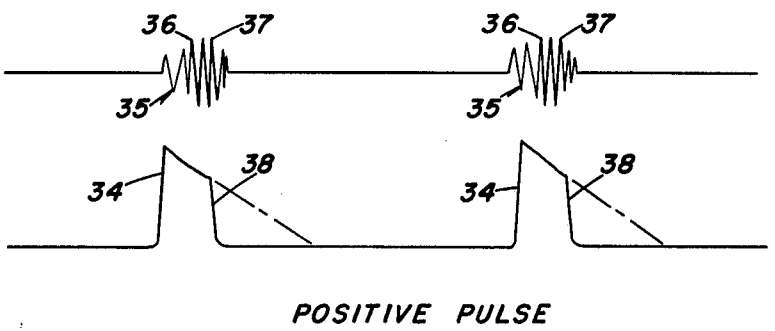
FIG. 2 is a graphic illustration of the positive pulse control and the resulting signal pulses.

The mode of operation of this embodiment can most conveniently be explained by reference to FIG. 2, in which the control impulses received from the grid 18 of the thyratron tube 16 appear as positive pulses 34. As soon as the positive pulse 34 is applied to the oscillator 10, said oscillator output begins to build up, and after a short build up period the radio frequency pulse, indicated at 35, will be of sufficient strength to be radiated. The full strength radiation should be emitted for a sufficient interval so that the first full-wave emission 36 will have time to return to the oscillator 10 from targets at the maximum permissible distance before the end of the oscillation pulse, shown at 37.

The pulse 34 attenuates rather rapidly but would produce an oscillation pulse 35 of considerable length, and it is generally desirable to utilize the clipper 12 to produce a sharp cut off 38 on pulse 34 and preferably the cut off 38 establishes the maximum radius of sensitivity. For example, if the maximum radius of sensitivity is desired to be 200 feet, then cut off 38 is adjusted so that wave 36 would be reflected from an object 200 feet away and return at or just before the end 37 of the radiated pulse 35.

Any radiation from pulse 35 that would have been picked up by a repeater jammer will be re-radiated, but will arrive after the end 37 of the pulse 35 so that it cannot be received by the gated detector 13, and consequently can do no harm to the fuze.

Figure 3:
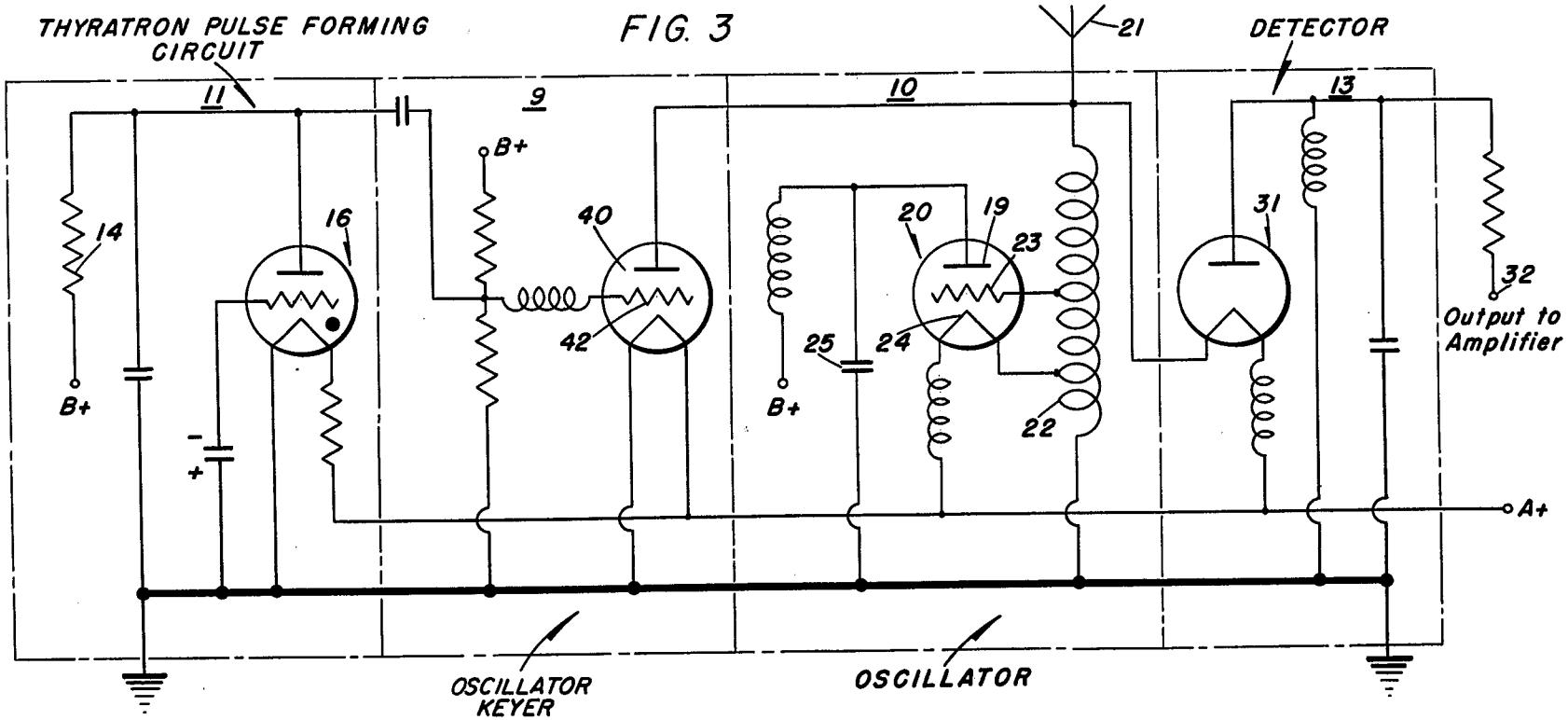
FIG. 3 is a circuit somewhat similar to FIG. 1 but showing a modification.
Figure 4:
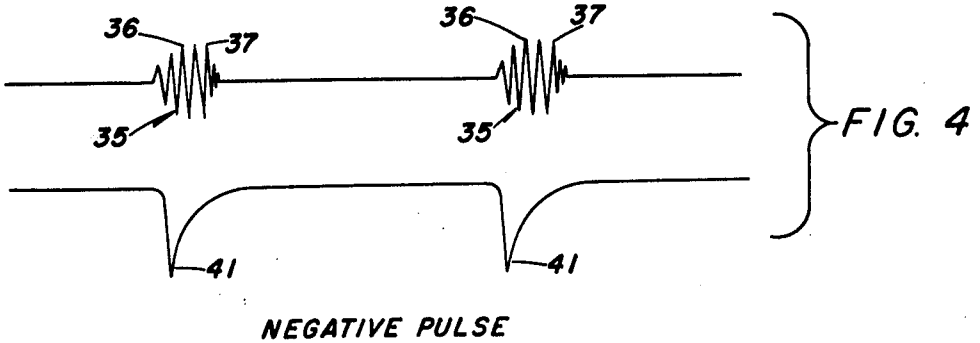
FIG. 4 is a graphic illustration showing negative biased pulses.

Instead of utilizing a positive impulse from the pulse forming circuit 11 to provide the power for the oscillator 10, it is likewise permissible to utilize the negative impulses, which occur at the plate of the thyratron during each conducting interval in a thyratron tube, to bias a short-circuiting or keyer tube 9 to inoperative i.e. non-conductive condition. Such a circuit is disclosed in FIG. 3, wherein oscillator 10 has connected in shunt therewith a triode tube 40 which, when conducting, has a sufficiently low impedance to substantially short-circuit the oscillator 10 and, therefore, to prevent any radiatable signals. Preferably the short-circuiting tube 40 is positively biased to be normally conducting and therefore to maintain the oscillator 10 inoperative. As seen in FIG. 4, the negative impulse 41 of the relaxation oscillator 11 is applied to the grid 42 of the short-circuiting tube 40 and depresses the voltage at the grid 42 to a valve where the tube 40 becomes non-conducting, at which time the oscillator 10 will become operative and radiate a pulse 35 of radio frequency energy. The effect of either of these systems is to produce short pulses 35 of radiated energy interposed between relatively long intervals when no energy is radiated. Obviously, if at the beginning of pulse 35 the projectile and its fuze had arrived within the immediate vicinity of any target object, said target object would, of course, reflect said pulse to the fuze and cause immediate operation thereof.

In the presently used proximity fuzes radio frequency signals at a frequency between 150 and 200 megacycles and pulses 35 at the rate of between 10,000 and 15,000 pulses per second have proven quite satisfactory. Obviously this can be varied as may be desirable by providing the suitable components for the relaxation oscillator circuit.

Obviously, many modifications and variations of the present invention are possible in the light of the above teachings. It is therefore to be understood that within the scope of the appended claims the invention may be practiced otherwise than as specifically described.

What is claimed is:

1. A radio proximity fuze comprising, an oscillator for generating radio frequency waves, an antenna for propagating said generated waves through space and for receiving waves reflected from a target and propagated through space toward said antenna, a detector for rectifying said generated waves and said received waves, an output connection to said detector for utilizing the detector output to fire said fuze, means for periodically supplying power to said radio frequency oscillator, said power means including a thyratron relaxation oscillator and a connection from said relaxation oscillator to said radio frequency oscillator, and means for rendering said detector insensitive to received waves during periods of non-operation of said oscillator whereby said fuze is afforded protection against jamming by remotely situated radio transmitters.

2. A fuze as claimed in claim 1, wherein said detector comprises a diode having anode and cathode electrodes, one of said electrodes being connected to said antenna, and wherein said means for rendering said detector insensitive comprises a resistor and a capacitor connected in parallel and connected from said anode electrode to said cathode electrode, the time constant of said resistor-capacitor combination being appreciably longer than the period of operation of said wave generating means.

3. A radio proximity fuze comprising, an oscillator including a resonant circuit and an electron tube connected to said resonant circuit, said oscillator generating radio frequency electrical waves upon the application of power thereto, an antenna for radiating said radio frequency waves and for receiving said radiated radio waves by reflection from a target, a detector connected to said antenna for rectifying both said radiated waves and said received waves to provide a signal for firing said fuze, and a source of power for said oscillator, said source including a thyratron having a grid, a connection from said grid to said electron tube, and means for periodically initiating and extinguishing gaseous discharges through said thyratron, the conduction from said thyratron grid to said electron tube providing power periodically for the operation of said oscillator.

* * * * *